US008457538B2

(12) United States Patent
Okamoto et al.

(10) Patent No.: US 8,457,538 B2
(45) Date of Patent: Jun. 4, 2013

(54) IMAGE FORMING APPARATUS AND METHOD OF IMAGE FORMING

(75) Inventors: Tetsuji Okamoto, Kanagawa (JP); Masahiro Sato, Kanagawa (JP); Atsushi Ogihara, Kanagawa (JP); Junichi Murakami, Kanagawa (JP); Koichi Watanabe, Kanagawa (JP); Shuichi Nishide, Kanagawa (JP); Atsuyuki Kitamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 276 days.

(21) Appl. No.: 12/906,603

(22) Filed: Oct. 18, 2010

(65) Prior Publication Data

US 2011/0318067 A1 Dec. 29, 2011

(30) Foreign Application Priority Data

Jun. 28, 2010 (JP) ..... 2010-146781

(51) Int. Cl.
*G03G 15/01* (2006.01)

(52) U.S. Cl.
USPC ..... 399/304; 399/45; 399/66; 101/410

(58) Field of Classification Search
USPC ..... 399/45, 66, 304, 389; 101/410
See application file for complete search history.

(56) References Cited

U.S. PATENT DOCUMENTS

| | | | | |
|---|---|---|---|---|
| 4,183,652 | A * | 1/1980 | Yanagawa | 399/117 |
| 4,202,268 | A * | 5/1980 | Becker | 101/409 |
| 4,862,214 | A * | 8/1989 | Kasahara et al. | 399/303 |
| 2006/0254443 | A1 * | 11/2006 | Lassen | 101/378 |
| 2011/0236081 | A1 * | 9/2011 | Okamoto et al. | 399/304 |

FOREIGN PATENT DOCUMENTS

| | | |
|---|---|---|
| JP | A-63-293573 | 11/1988 |

* cited by examiner

*Primary Examiner* — Walter L Lindsay, Jr.
*Assistant Examiner* — Benjamin Schmitt
(74) *Attorney, Agent, or Firm* — Oliff & Berridge, PLC

(57) ABSTRACT

An image forming apparatus includes an image carrier that is rotatable; a transfer member that is rotatably disposed so as to face the image carrier, the transfer member transferring an image carried by the image carrier to a sheet; a leading end gripping member that is attached to the transfer member, the leading end gripping member gripping a leading end of the sheet in the transport direction on an outer peripheral surface of the transfer member; a trailing end holding member that holds a trailing end of the sheet in the transport direction between the trailing end holding member and the outer peripheral surface of the transfer member; and a controller that changes a distance between the leading end gripping member and the trailing end holding member when holding the sheet on the basis of a length of the sheet in the transport direction.

15 Claims, 9 Drawing Sheets

IMAGE FORMING APPARATUS AND METHOD OF IMAGE FORMING

CROSS-REFERENCE TO RELATED APPLICATIONS

This application is based on and claims priority under 35 USC 119 from Japanese Patent Application No. 2010-146781 filed Jun. 28, 2010.

BACKGROUND

Technical Field

The present invention relates to an image forming apparatus and a method of image forming.

SUMMARY

According to an aspect of the invention, an image forming apparatus includes an image carrier that is rotatably disposed, the image carrier carrying an image on an outer peripheral surface thereof; a transfer member that is rotatably disposed so as to face the image carrier, the transfer member transferring the image carried by the image carrier to a sheet that is nipped between the transfer member and the image carrier; a leading end gripping member that is attached to the transfer member, the leading end gripping member gripping a leading end of the sheet in a transport direction on an outer peripheral surface of the transfer member, the sheet being supplied to the transfer member; a trailing end holding member that holds a trailing end of the sheet in the transport direction between the trailing end holding member and the outer peripheral surface of the transfer member, the sheet being supplied to the transfer member; and a controller that changes a distance between the leading end gripping member and the trailing end holding member when holding the sheet on the basis of a length of the sheet in the transport direction, the sheet being supplied to the transfer member.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described in detail with reference to the attached drawings.

Overall Structure of Image Forming Apparatus 1

Figure 1:
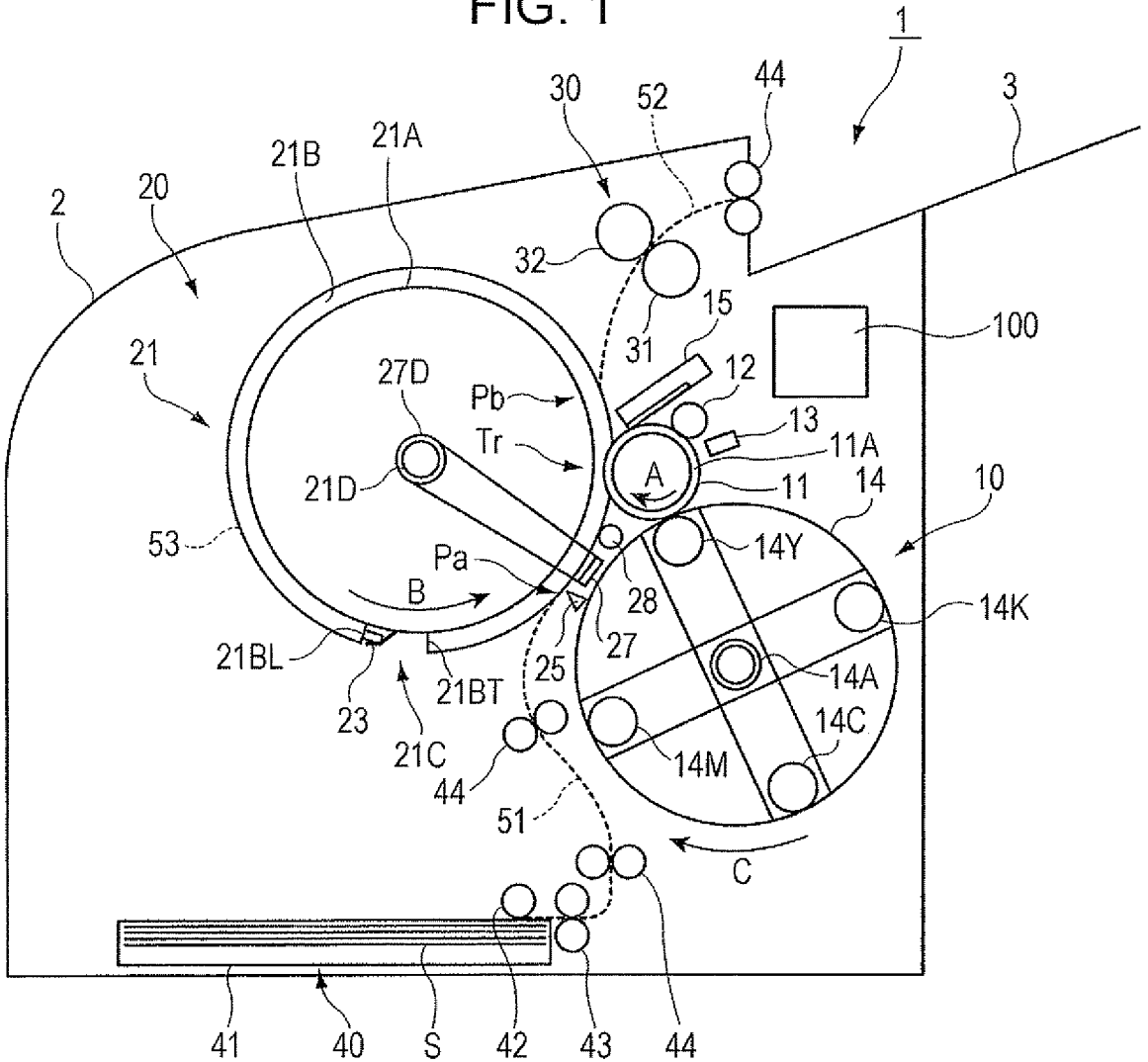
FIG. 1 is a schematic view of an image forming apparatus according to an exemplary embodiment.
Figure 2A:
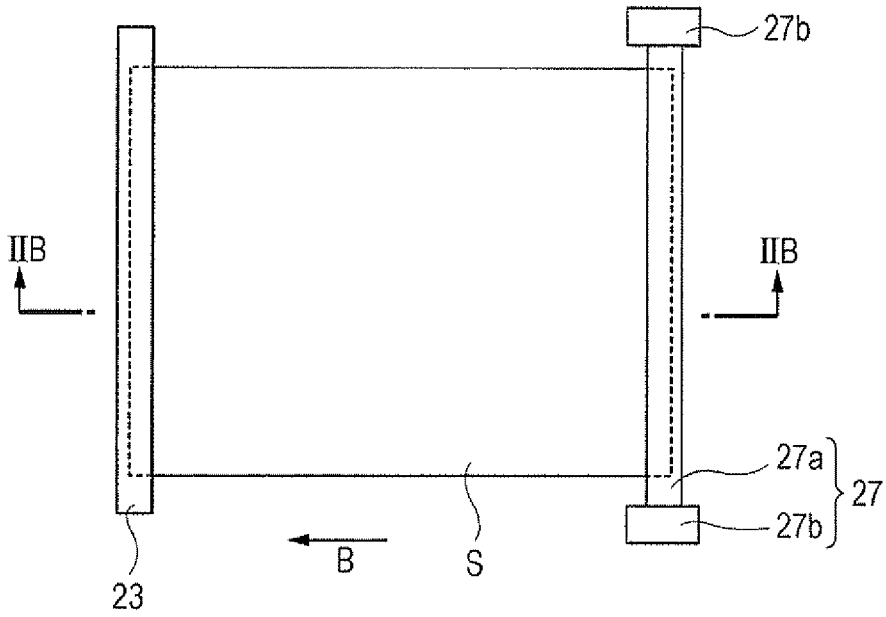
FIGS. 2A and 2B are schematic views illustrating the relationships among a sheet, a leading end gripper, and a trailing end gripper according to the present exemplary embodiment.
Figure 2B:
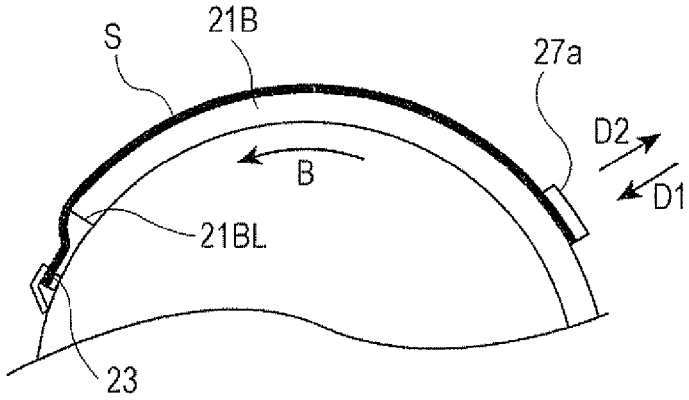
Figure 3:
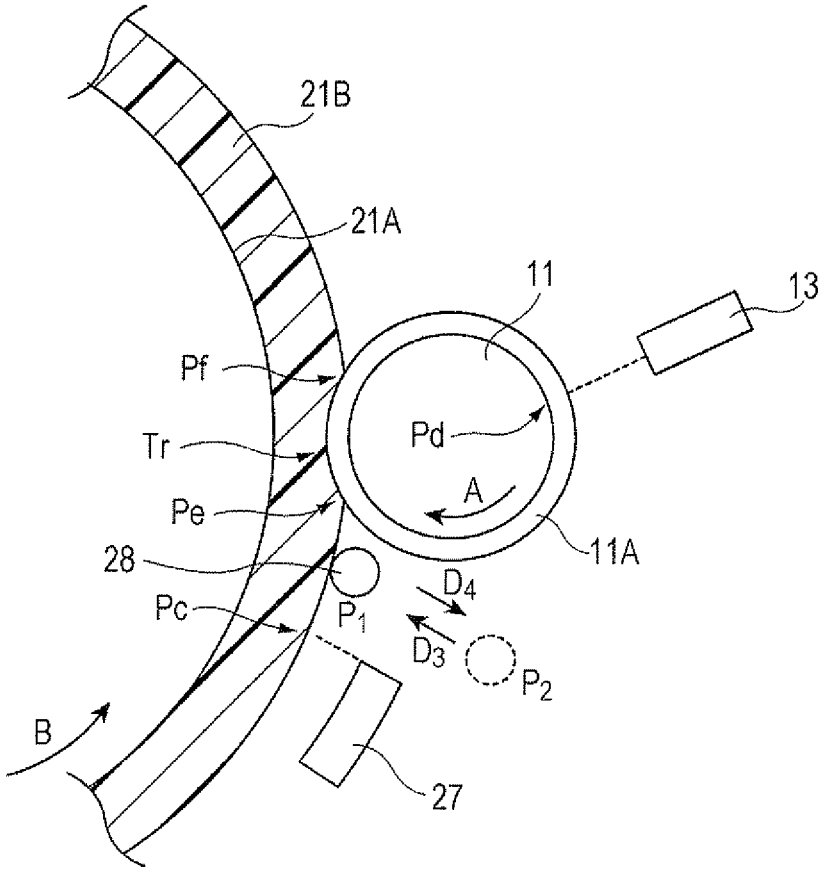
FIG. 3 is a schematic view illustrating the vicinity of a transfer region according to the present exemplary embodiment.

Referring to FIGS. 1 to 3, the structure of an image forming apparatus 1 according to an exemplary embodiment will be described. FIG. 1 is a schematic view illustrating the image forming apparatus 1 according to the present exemplary embodiment. FIGS. 2A and 2B are schematic views illustrating the relationships among a sheet S, a leading end gripper 23, and a trailing end gripper 27 according to the present exemplary embodiment. FIG. 2A illustrates the leading end gripper 23 and the trailing end gripper 27, which are holding the sheet S, viewed from the outside of the image forming apparatus 1. FIG. 2B is a sectional view of the leading end gripper 23 and the trailing end gripper 27, which are holding the sheet S, taken along line IIB-IIB of FIG. 2A. FIG. 3 is a schematic view illustrating the vicinity of a transfer region Tr.

The image forming apparatus 1 includes an image forming unit 10, a sheet feeding unit 40, a transfer device 20, a fixing unit 30, and a controller 100. The image forming unit 10 forms a toner image. The sheet feeding unit 40 feeds and transports the sheet S. The transfer device 20 holds the sheet S that is supplied and transfers the image formed by the image forming unit 10 to the sheet S. The fixing unit 30 fixes the toner image on the sheet S that has been released from the transfer device 20. The controller 100 controls the entirety of the image forming apparatus 1. A housing 12 contains the components of the image forming apparatus 1. A sheet stacker 3 is disposed on the housing 12. The sheet stacker 3 stacks the sheets S that have been output from the fixing unit 30.

Structures of Components

The image forming unit 10 includes a photoconductor drum 11, which is an example of an image carrier. The image forming unit 10 further includes a charger 12, an exposure device 13, a rotary developing device 14, and a cleaner 15. The charger 12 charges the photoconductor drum 11. The exposure device 13 exposes the photoconductor drum 11, which has been charged, to light. The rotary developing device 14 performs development using developer. The cleaner 15 cleans the photoconductor drum 11 by removing the developer that has been left on the photoconductor drum. Each of the components will be described below.

The photoconductor drum 11 includes a photosensitive layer 11A whose surface is negatively charged. The photoconductor drum 11 rotates in the direction of arrow A. The charger 12, the exposure device 13, the rotary developing device 14, and the cleaner 15 are disposed around the photoconductor drum 11 in this order in the direction of arrow A. The outer diameter of the photoconductor drum 11 is, for example, 30 mm.

In the present exemplary embodiment, the charger 12 is a contact roller charger. The charger rotates together with the photoconductor drum 11 and charges the photoconductor drum 11. The exposure device 13 forms an electrostatic latent image by irradiating a charged surface of the photoconductor drum 11 with light. In the present exemplary embodiment, the exposure device 13 includes plural LEDs (not shown).

The rotary developing device 14 includes a rotary shaft 14A and developing units 14Y, 14M, 14C, and 14K for yellow (Y), magenta (M), cyan (C), and black (K), respectively. The developing units 14Y, 14M, 14C, and 14K are disposed around the rotary shaft 14A. The rotary developing device 14 rotates around the rotary shaft 14A in the direction of arrow C. One of the developing units of the rotary developing device 14 stops at a position facing the photoconductor drum 11. The rotary developing device 14 develops the electrostatic latent image, which has been formed on the photoconductor drum 11 by the exposure device 13, by using toner. The outer diameter of the rotary developing device 14 is, for example, 100 mm. The developing units 14Y, 14M, 14C, and 14K each contain two-component developer that includes toner and carrier of a corresponding color. In the present exemplary embodiment, two-component developer is used. Instead, one-component developer may be used. In the description below, two-component developer will be simply called developer. The cleaner 15 removes developer and other substances that are left on the surface of the photoconductor drum 11. In the present exemplary embodiment, the cleaner 15 is a blade-type cleaner.

Next, the transfer device 20 will be described. The transfer device 20 includes a transfer drum 21, which transfers a toner image formed on the photoconductor drum 11 to the sheet S. The transfer device 20 includes the leading end gripper 23 and the trailing end gripper 27. The leading end gripper 23, which is an example of a leading end gripping member, grips the leading end of the sheet S on the transfer drum 21. The trailing end gripper 27, which is an example of a trailing end holding member, holds the trailing end of the sheet S on the transfer drum 21. The transfer device 20 further includes a sheet detection sensor 25 and a sheet smoothing roller 28. The sheet detection sensor 25, which is an example of a sheet detector, detects passing of the sheet S. The sheet smoothing roller 28 presses the sheet S against the transfer drum 21 and smoothes the sheet S. The transfer device 20 further includes a transfer drum driving motor M1 (described below) and a transfer drum gear G1 (described below). The transfer drum driving motor M1 rotates the transfer drum 21. The transfer drum gear G1 connects the transfer drum driving motor M1 to a rotary shaft 21D. Hereinafter, components other than the leading end gripper 23 and the trailing end gripper 27 will be described first. Then, the leading end gripper 23 and the trailing end gripper 27 will be described independently. The transfer drum 21, which is an example of a transfer member, faces the photoconductor drum 11, and is deposed so as to be rotatable around the rotary shaft 21D. The transfer drum 21 includes a base portion 21A and an elastic layer 21B. The base portion 21A has a drum-like shape. The elastic layer 21B is formed on the outer peripheral surface of the base portion 21A. To be specific, the elastic layer 21B extends along the outer periphery of the base portion 21A, which has a drum-like shape, from a leading end 21BL of the elastic layer to a trailing end 21BT of the elastic layer. The leading end 21BL of the elastic layer corresponds to the leading end of the sheet S in the transport direction. The trailing end 21BT of the elastic layer corresponds to the trailing end of the sheet S in the transport direction. The elastic layer 21B does not cover a part of the outer peripheral surface of the base portion 21A, the part extending along the axis of the base portion 21A and being located between the trailing end 21BT of the elastic layer and the leading end 21BL of the elastic layer. The part, at which the base portion 21A is exposed, will be referred to as an exposed portion 21C. The elastic layer 21B of the transfer drum 21 elastically deforms and thereby a nip is formed between the transfer drum 21 and the photoconductor drum 11. The transfer drum 21 rotates in synchronism with the photoconductor drum 11 with the nip therebetween. The rotary shaft (not shown) of the photoconductor drum 11 and the rotary shaft 21D of the transfer drum 21 are fixed to the image forming apparatus 1. Therefore, the distance between the rotary shafts of the photoconductor drum 11 and the transfer drum 21 remains constant. The exposed portion 21C of the transfer drum 21 does not contact the photoconductor drum 11. The outer diameter of the transfer drum 21 is larger than the outer diameter of the photoconductor drum 11.

In the present exemplary embodiment, the base portion 21A is a conductive hollow tube made of, for example, a metal. The elastic layer 21B is a semi-conductive elastic member made of, for example, a polyurethane resin. A dielectric member, such as a dielectric sheet, is not disposed on the outer peripheral surface of the elastic layer 21B. A charger for generating electrostatic attraction, such as a corotron, is not disposed in the transfer drum 21. That is, the transfer drum 21 is not configured to hold the sheet S by using electrostatic attraction. The friction that is generated between the outer peripheral surface of the elastic layer 21B and the sheet S when the sheet S passes the transfer region Tr (described below), where a toner image is transferred to the sheet S, is lower than the friction that is generated between the outer peripheral surface of the photoconductor drum 11 and the sheet S at that time. The circumference of the transfer drum 21 (to be specific, the circumference of the elastic layer 21B) is larger than the maximum length (maximum print length) of an image formed on the sheet S by the image forming apparatus 1 in the transport direction of the sheet S.

A high-voltage power supply (not shown) applies a transfer bias to the base portion 21A. The transfer bias has a voltage of opposite polarity with respect to the toner. Thus, toner for forming a toner image on the photoconductor drum 11 is transferred to the sheet S on the elastic layer 21B in the transfer region Tr. The transfer region Tr is a region in which the photoconductor drum 11 faces the transfer drum 21 and in which the photoconductor drum 11 contacts the transfer drum 21 so as to transfer a toner image formed on the photoconductor drum 11 to the sheet S on the elastic layer 21B. To be specific, as illustrated in FIG. 3, the transfer region Tr is a region extending from a contact start point Pe through a contact region to a contact end point Pf. The contact start point Pe is a point at which the photoconductor drum 11 and the transfer drum 21, which are rotating, start contacting each other. The contact region is a region in which the photoconductor drum 11 and the transfer drum 21 contact each other. The contact end point Pf, which is located downstream of the contact start point Pe in the transfer direction of sheet S, is a point at which the contact between the photoconductor drum 11 and the transfer drum 21 ends while these drums rotate.

The sheet detection sensor 25 is disposed so as to face the outer peripheral surface of the transfer drum 21. The sheet detection sensor 25 detects passing of the sheet S, which is transported while being wrapped around the transfer drum 21. To be specific, the sheet detection sensor 25 emits near-infrared light toward the outer peripheral surface of the transfer drum 21. Then, the sheet detection sensor 25 receives reflected light (near-infrared light) that is reflected from the sheet S, which is held on the outer peripheral surface of the transfer drum 21, or from the transfer drum 21. Passing of the leading end of the sheet S in the transport direction and passing of the trailing end of the sheet S in the transport direction are detected by, for example, detecting a change in the amount of reflected light. The sheet detection sensor 25 is disposed upstream of the standby position (described below) of the trailing end gripper 27 with respect to the transport direction of the sheet S. In the present exemplary embodiment, the sheet detection sensor 25 is disposed between the standby position of the trailing end gripper 27 and a sheet feed position Pa (described below). The sheet detection sensor 25 measures the phase of the transfer drum 21, which is rotating, by detecting markings on the transfer drum 21 (not shown).

In the present exemplary embodiment, the sheet smoothing roller 28 is a roller-shaped member made of a metal. The sheet smoothing roller 28 is disposed upstream of the transfer region Tr with respect to the transport direction of the sheet S. The sheet smoothing roller 28 is disposed downstream of the sheet feed position Pa (described below) and the standby position (described below) of the trailing end gripper 27 with respect to the transport direction of the sheet S. The sheet smoothing roller 28 is movable so as to be in contact with and separated from the transfer drum 21 (see arrows D3 and D4 of FIG. 3). The sheet smoothing roller 28 may be omitted if the standby position of the trailing end gripper 27 is near to the transfer region Tr.

The fixing unit 30 includes a heating roller 31 and a pressing roller 32. The heating roller 31, which is rotatable, includes a heater (not shown). The pressing roller 32 is pressed against the heating roller 31.

The sheet feeding unit 40 includes a sheet container 41, a sheet-size sensor (not shown), a pickup roller 42, a separation roller 43, and a transport roller 44. The sheet container 41, which contains the sheet S, is disposed in a lower part of the image forming apparatus 1 and below the transfer drum 21. The sheet-size sensor (not shown) is attached to the pickup roller 42 and detects the size of the sheet that is contained in the sheet feeding unit 40. The pickup roller 42 picks up the sheet S from the sheet container 41. The separation roller 43 separates the sheet S from a stack of sheets. The transport roller 44 transports the sheet S.

The image forming apparatus 1 does not include a member, such as a peeling claw, that contacts the transfer drum 21 and peels off the sheet S that is wrapped around the transfer drum 21. This is because, the sheet S wrapped around the transfer drum 21 is peeled off from the transfer drum 21 due to the function of a nip between the transfer drum 21 and the photoconductor drum 11 as will be described below in detail. Thus, the peeling claw is not necessary, whereby the size of the image forming apparatus 1 according to the present exemplary embodiment is reduced. Although the peeling claw is omitted, a guide member (such as a sheet transport path) that guides the sheet S to an output path 52 after the leading end of the sheet S in the transport direction has been peeled off the transfer drum 21 may be provided. That is, in the exemplary embodiment of the present invention, a sheet transport path may be disposed downstream of the sheet output position Pb (described below) in the transport direction so as not to be in contact with the transfer drum 21, and the sheet transport path may guide the sheet S that has been peeled off.

The controller 100 receives a signal from a user interface (not shown), to which a user inputs a command. The controller 100 receives an image signal from an image output command unit (not shown), which is disposed inside or outside the image forming apparatus 1. The controller 100 receives a signal that indicates passing of the sheet S and a phase signal of the photoconductor drum 11 from the sheet detection sensor 25. The controller 100 outputs control signals to the following components: a photoconductor drum driving member (not shown) that rotates the photoconductor drum 11; the charger 12; the exposure device 13; a developing device driver (not shown) that rotates/stops the rotary developing device 14 so that a desired one of the developing units 14Y, 14M, 14C, and 14K is located at a development position that is opposite the photoconductor drum 11; a development bias setting unit (not shown) that sets a development bias that is supplied to one of the developing units 14Y, 14M, 14C, and 14K located at the development position; a transfer drum driving member that rotates the transfer drum 21 (see the transfer drum driving motor M1 and the transfer drum gear G1 in FIGS. 5A to 5C); a trailing end gripper driving member that rotates the trailing end gripper 27 (see a trailing end gripper driving motor M2 and a trailing end gripper gear G2 in FIGS. 5A to 5C); a transfer bias setting unit (not shown) that sets the transfer bias of the transfer drum 21; the leading end gripper 23; the trailing end gripper 27; the sheet feeding unit 40; and the fixing unit 30.

The image forming apparatus 1 includes a feed path 51 and the output path 52. Through the feed path 51, the sheet S is supplied from the sheet container 41 to the transfer region Tr. Through the output path 52, the sheet S, on which a toner image has been transferred, is output to the sheet stacker 3 through the fixing unit 30. In the present exemplary embodiment, after the sheet S has been transported to the transfer drum 21, the sheet S is wrapped around the transfer drum 21 by the leading end gripper 23 and the trailing end gripper 27 and rotated. The path that the sheet S passes through at this time will be referred to as a rotation path 53. In the present exemplary embodiment, the sheet S is supplied from the sheet container 41 through the feed path 51 to a sheet feed position Pa. The sheet feed position Pa is located upstream of the transfer region Tr with respect to the rotation direction (arrow B) of the transfer drum 21. In the present exemplary embodiment, the sheet S is output from a sheet output position. Pb through the output path 52 to the fixing unit 30. The sheet output position Pb is located downstream of the transfer region Tr with respect to the rotation direction (arrow B) of the transfer drum 21. In the present exemplary embodiment, the sheet S, which has been supplied to the transfer drum 21, is wrapped around the transfer drum 21 by the leading end gripper 23 and the trailing end gripper 27 and rotated, and passes through the rotation path 53.

Leading End Gripper 23 and Trailing End Gripper 27

Figure 4A:
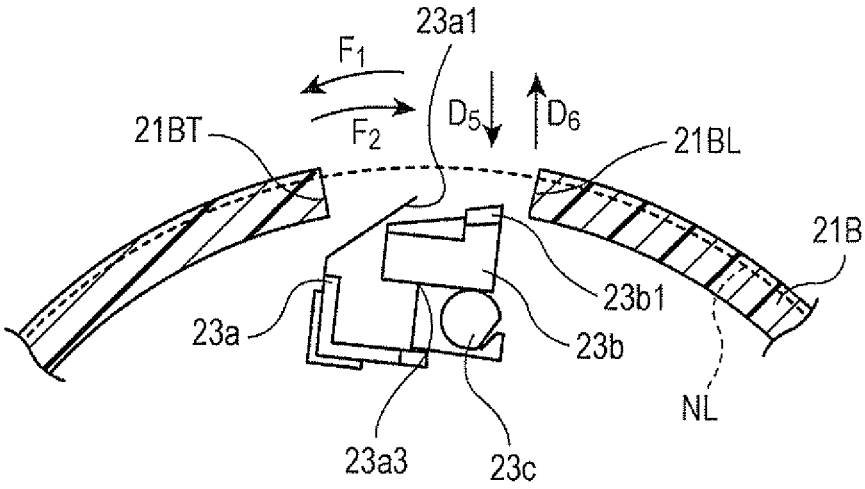
FIGS. 4A and 4B are schematic views illustrating the leading end gripper according to the present exemplary embodiment.
Figure 4B:
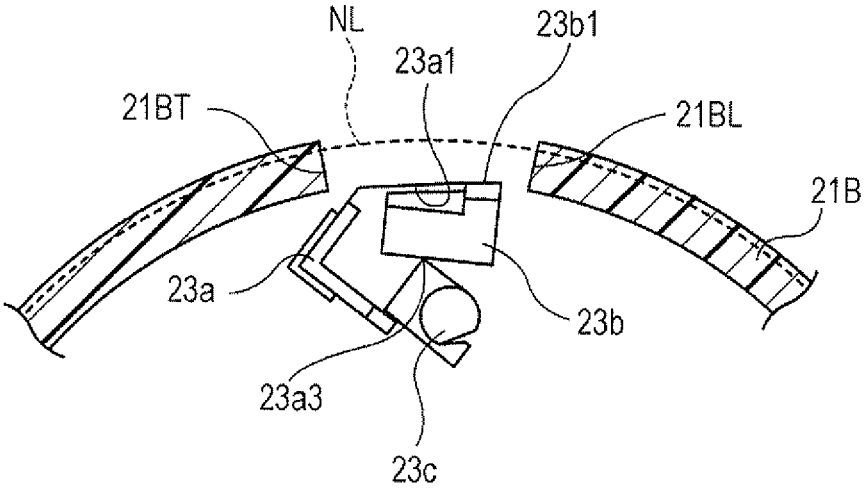
Figure 5A:
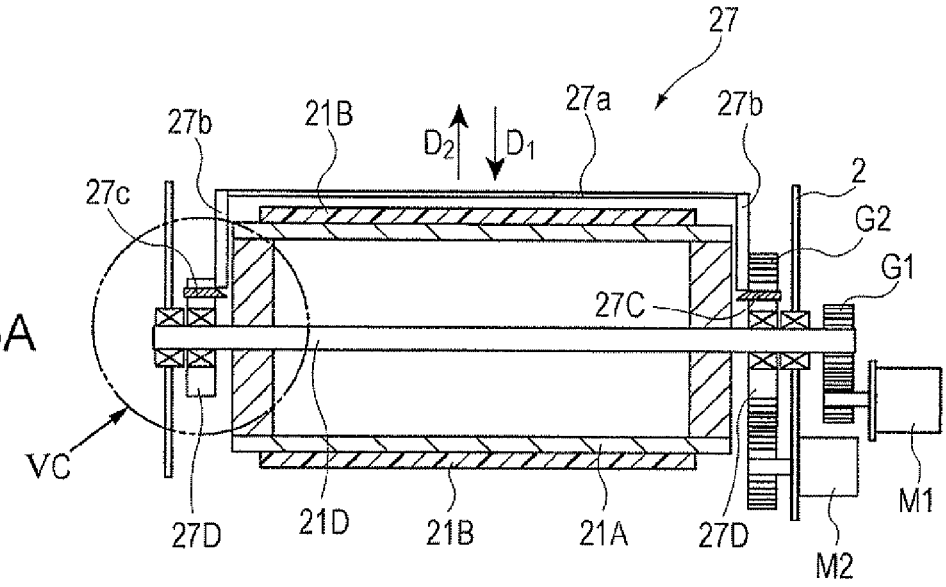
FIGS. 5A to 5C are schematic views illustrating the trailing end gripper according to the present exemplary embodiment.
Figure 5B:
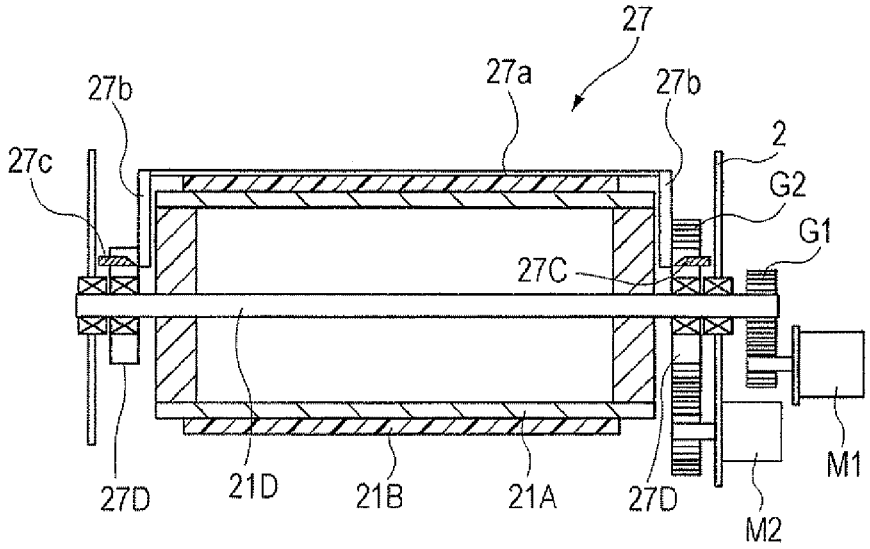
Figure 5C:
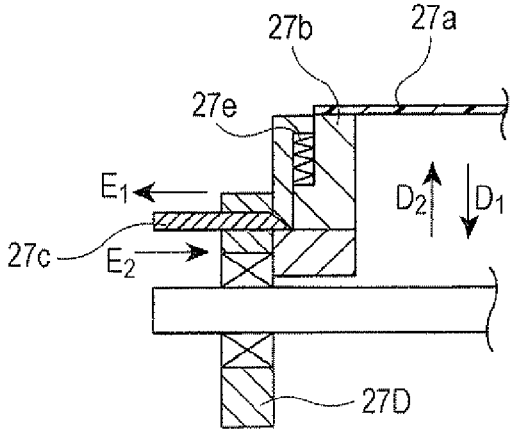

Next, referring to FIGS. 1 to 5C, the structures of the leading end gripper 23 and the trailing end gripper 27 will be described. FIGS. 4A and 4B are schematic views of the leading end gripper 23 according to the present exemplary embodiment. FIG. 4A is a sectional view of the leading end gripper 23 in an open state taken along a plane that intersects the rotary shaft 21D of the transfer drum 21. FIG. 4B is a sectional view of the leading end gripper 23 in a closed state taken along a plane that intersects the rotary shaft 21D of the transfer drum 21. FIGS. 5A and 5B are schematic views of the trailing end gripper 27 according to the present exemplary embodiment. FIG. 5A is a sectional view of the trailing end gripper 27 in an open state and the transfer drum 21 taken along a plane that extends along the rotary shaft 21D of the transfer drum 21. FIG. 5B is a sectional view of the trailing end gripper 27 in a closed state and the transfer drum 21 taken along a plane that extends along the rotary shaft 21D of the transfer drum 21. FIG. 5C is a partial enlarged view of the trailing end gripper 27 illustrating a region surrounded by a circle VC in FIG. 5A.

The leading end gripper 23 and the trailing end gripper 27 are openable and closable. The leading end gripper 23 and the trailing end gripper 27 are rotatable together with the transfer drum 21. The leading end gripper 23 and the trailing end gripper 27 are configured to hold the sheet S on the transfer drum 21. To be specific, as illustrated in FIGS. 2A and 2B, the leading end gripper 23 grips the leading end of the sheet S (the left end in FIGS. 2A and 2B) in the transport direction (arrow B) of the sheet S on the transfer drum 21, and the trailing end gripper 27 holds the trailing end of the sheet S (the right end in FIGS. 2A and 2B) in the transport direction (arrow B) of the sheet S. The leading end gripper 23 is attached to the transfer drum 21 (see FIG. 1). The trailing end gripper 27 is a member that is independent of the transfer drum 21 (see FIG. 1), and the position of the trailing end gripper 27 relative to the transfer drum 21 changes. When the leading end gripper 23 grips the sheet S, the leading end gripper does not allow a movement of the sheet S in the transport direction and restricts a movement of the sheet S in a direction in which the sheet S is separated from the transfer drum 21. When the trailing end gripper 27 holds the sheet S, the trailing end gripper 27 allows a movement of the sheet S in the transport direction and restricts a movement of the sheet S in a direction in which the sheet S is separated from the transfer drum 21. Hereinafter, the structures of the leading end gripper 23 and the trailing end gripper 27 will be described in detail.

Leading End Gripper 23

The leading end gripper 23 is attached to the exposed portion 21C of the transfer drum 21. To be specific, the leading end gripper 23 is disposed between the trailing end 21BT of the elastic layer and the leading end 21BL of the elastic layer. The leading end gripper 23 is configured so that the leading end gripper 23 does not contact the photoconductor drum 11 irrespective of whether the leading end gripper 23 is in the open state or in the closed state, as will be described below. The leading end gripper 23 includes an outer member 23*a*, an inner member 23*b*, and a rotary shaft 23*c*. The outer member 23*a* presses the sheet S from the outer side (the upper side in FIGS. 4A and 4B) of the transfer drum 21. The inner member 23*b* presses the sheet S from the inner side (the lower side in FIGS. 4A and 4B) of the transfer drum 21. The rotary shaft 23*c* is integrally formed with the outer member 23*a*. The outer member 23*a*, the inner member 23*b*, and the rotary shaft 23*c* are disposed between the trailing end 21BT of the elastic layer and the leading end 21BL of the elastic layer. The outer member 23*a* rotates around the rotary shaft 23*c*, which is fixed to the transfer drum 21, between the trailing end 21BT of the elastic layer and the leading end 21BL of the elastic layer. As a result, the relative positions of the outer member 23*a* and the inner member 23*b* are changed, whereby the leading end gripper 23 is opened and closed. As illustrated in FIGS. 4A and 4B, when the leading end gripper 23 is opened, the opening faces downstream in the transport direction of the sheet S.

The outer member 23*a* of the leading end gripper 23 is configured to be rotatable around the rotary shaft 23*c* between the outer periphery of the transfer drum 21 and the rotary shaft 23*c* (arrows F1 and F2 of FIGS. 4A and 4B). The outer member 23*a* includes an outer pressing portion 23*a*1 and an edge portion 23*a*3. The outer pressing portion 23*a*1 presses a surface of the sheet S, on which an image is formed, from the outer side of the transfer drum 21. The edge portion 23*a*3 presses the inner member 23*b* as the outer member 23*a* rotates around the rotary shaft 23*c*. The outer pressing portion 23*a*1 is disposed between the inner member 23*b* and the outer periphery of the transfer drum 21. The edge portion 23*a*3 is disposed between the inner member 23*b* and the rotary shaft of the transfer drum 21. The outer member 23*a* has a small thickness so that the outer member 23*a* may not contact the photoconductor drum 11 in the transfer region Tr. The outer member 23*a* is made of a metal such as a stainless steel (SUS). The inner member 23*b* of the leading end gripper 23 is supported by the transfer drum 21 so as to be movable along a guide member (not shown) in the radial directions of the transfer drum 21 (arrows D5 and D6 of FIGS. 4A and 4B). The inner member 23*b* includes an inner pressing portion 23*b*1 that presses a surface of the sheet S, on which an image is not formed, from the inner side of the transfer drum 21. The rotary shaft 23*c* extends in a direction parallel to the rotary shaft 21D of the transfer drum 21. The rotary shaft 23*c* is disposed in the transfer drum 21 at a position near to the outer periphery of the transfer drum 21.

In the present exemplary embodiment, as illustrated in FIG. 4A, when the leading end gripper 23 is in the open state, there is a gap between the outer pressing portion 23*a*1 and the inner pressing portion 23*b*1. On the other hand, as illustrated in FIG. 4B, when the leading end gripper 23 is in the closed state, the outer pressing portion 23*a*1 and the inner pressing portion 23*b*1 become adjacent to each other so that the gap between the outer pressing portion 23*a*1 and the inner pressing portion 23*b*1 disappears.

Trailing End Gripper 27

As illustrated in FIGS. 5A to 5C, the trailing end gripper 27 extends across the transfer drum 21 in a direction parallel to a rotary shaft 27D of the transfer drum 21. The trailing end gripper 27 rotates around the rotary shaft 270 independently of the transfer drum 21. To be specific, as illustrated in FIGS. 5A to 5C, the trailing end gripper 27 includes a sheet restrictor 27*a* and holding portions 27*b*. The sheet restrictor 27*a* faces the outer peripheral surface of the transfer drum 21 and restricts a movement of the sheet S. The holding portions 27*b* hold ends of the sheet restrictor 27*a*. The holding portions 27*b* are connected to the rotary shaft 270. The trailing end gripper 27 includes wedge-shaped lifting members 27*c*, which move the holding portions 27*b* and thereby move the sheet restrictor 27*a* in the radial direction of the transfer drum 21. The trailing end gripper 27 is configured to be opened and closed by changing the distance between the sheet restrictor 27*a* and the outer peripheral surface of the transfer drum 21 (arrows D1 and D2 of FIGS. 5A to 5C).

The rotary shaft 270 of the trailing end gripper 27 is coaxial with the rotary shaft 21D of the transfer drum 21. However, the transfer drum 21 and the trailing end gripper 27 are rotated independently. To be specific, the transfer drum 21 is rotated by the transfer drum driving motor M1 and the transfer drum gear G1. The trailing end gripper 27 is rotated by the trailing end gripper driving motor M2 and the trailing end gripper gear G2. The trailing end gripper gear G2 connects the trailing end gripper driving motor M2 to one of the holding portions 27*b*.

The sheet restrictor 27*a* extends in a direction parallel to the rotary shaft 21D of the transfer drum 21. The sheet restrictor 27*a* has a length that is larger than the maximum width of the sheet S that may be used in the image forming apparatus 1 according to the present exemplary embodiment (the length of the sheet S in the direction parallel to the rotary shaft 21D when the sheet S is disposed on the outer peripheral surface of the transfer drum 21). The trailing end gripper 27 has a small thickness because the trailing end gripper 27 contacts the photoconductor drum 11 in the transfer region Tr (as will be described below). A part of the sheet restrictor 27*a* of the trailing end gripper 27 that contacts the photoconductor drum 11 does not have angular portions. This is to reduce damage to the photoconductor drum 11 that may occur when the trailing end gripper 27 contacts the photoconductor drum 11. In the present exemplary embodiment, the sheet restrictor 27*a* is a plate-shaped member. However, the shape of the sheet restrictor 27*a* of the trailing end gripper 27 may be film-like, wire-like, or cylindrical. The sheet restrictor 27*a* is made of, for example, polyethylene terephthalate (PET), a polyimide resin, or a fluorocarbon resin.

The holding portions 27*b*, which are attached to both ends of the sheet restrictor 27*a*, face each other with a space therebetween. The space has a length that is larger than the maximum width of the sheet that may be used in the image forming apparatus 1. The holding portions 27*b* are rotatable around the rotary shaft 27D. The holding portions 27*b* extend in the radial direction of the transfer drum 21, and the holding portions 27*b* are movable in the radial direction of the transfer drum 21. Springs 27*e* urge the holding portions 27*b* in a direction from the outer side toward the inner side of the transfer drum 21.

The wedge-shaped lifting members 27*c* are rotatable around the rotary shaft 27D together with the holding portions 27*b*. The wedge-shaped lifting members 27*c* are driven by a solenoid (not shown) so as to be movable in directions parallel to the rotary shaft 27D (arrows E1 and E2 of FIGS. 5A to 5C). When the wedge-shaped lifting members 27*c* move in the directions parallel to the rotary shaft 27D, the holding portions 27*b* are moved in the radial direction of the transfer drum 21. To be specific, each of the wedge-shaped lifting members 27*c* has a wedge-shaped end. That is, the thickness of each of the wedge-shaped lifting members 27*c* in the radial direction of the transfer drum 21 decreases toward the tip of the wedge-shaped end. In the present exemplary embodiment, the wedge-shaped lifting members 27*c* are disposed at ends of the rotary shaft 27D so that the wedge-shaped ends face each other. The wedge-shaped lifting members 27*c* are disposed so as to extend in a direction parallel to the rotary shaft 27D. The wedge-shaped ends of the wedge-shaped lifting members 27*c* face inner ends of the holding portions 27*b*. The wedge-shaped lifting members 27*c* rotate around the rotary shaft 27D together with the holding portions 27*b*. When, for example, the sheet restrictor 27*a* is stopped at a standby position (described below), the wedge-shaped lifting members 27*c* move to positions between the holding portions 27*b* and the rotary shaft 21D and move the holding portions 27*b* outward, so that the sheet restrictor 27*a* is moved away from the outer peripheral surface of the transfer drum 21. Thus, the trailing end gripper 27 is opened.

In the present exemplary embodiment, as illustrated in FIG. 5A, when the trailing end gripper 27 is in the open state, the wedge-shaped lifting members 27*c* are supporting the inner ends of the holding portions 27*b*. At this time, there is a large gap between the sheet restrictor 27*a* and the elastic layer 21B in the outer periphery of the transfer drum 21. On the other hand, as illustrated in FIG. 5B, when the trailing end gripper 27 is in the closed state, the wedge-shaped lifting members 27*c* do not support the inner ends of the holding portions 27*b*. At this time, there is a small gap between the sheet restrictor 27*a* and the elastic layer 21B. When the trailing end gripper 27 is in the open state as illustrated in FIG. 5A, the leading end gripper 23 that is holding the sheet S is allowed to pass through the gap between the sheet restrictor 27*a* and the elastic layer 21B.

Operation of Image Forming Apparatus 1

Figure 6:
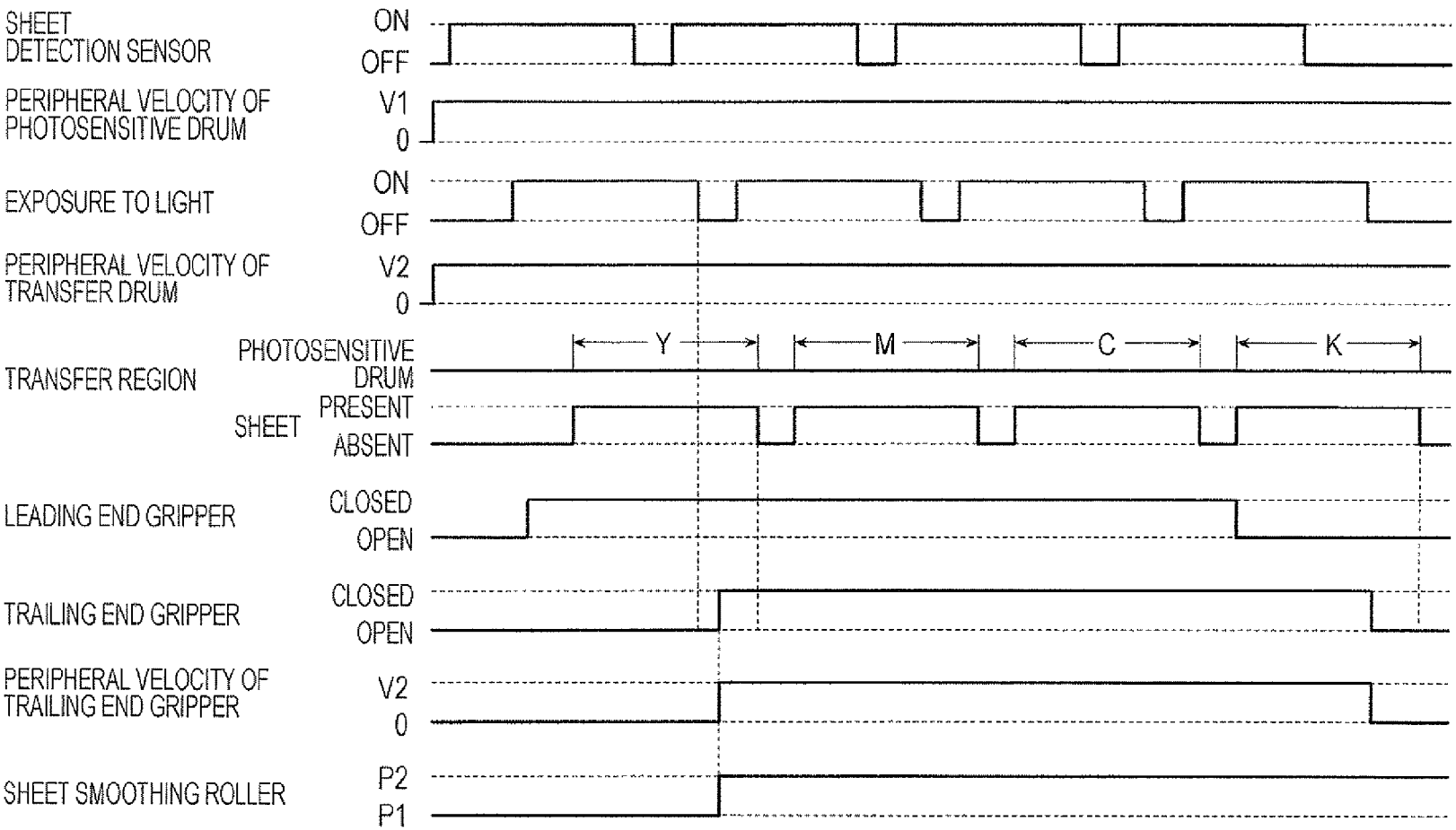
FIG. 6 is a timing chart of an image forming operation according to the present exemplary embodiment.

Next, referring to FIGS. 1 to 8D, the overall operation of the image forming apparatus 1 will be described. Here, the image forming apparatus 1 performs an image forming operation of forming an image of plural colors on the sheet S. FIG. 6 is a timing chart of the image forming operation. FIGS. 7A to 7D are schematic views illustrating the operation of wrapping the sheet S around the transfer drum 21. FIGS. 8A to 8D are schematic views illustrating the operation of releasing the sheet S, which is wrapped around the transfer drum 21, from the transfer drum 21.

First, image data for a reflected color image of a document read by a document reader (not shown) or image data generated by a personal computer (not shown) is input to an image signal processor (not shown) as data for, for example, red (R), green (G), and blue (B), and subjected to predetermined image processing. The image data that has been processed is converted to color gradation data for yellow (Y), magenta (M), cyan C, and black (K), and output to the exposure device 13.

When the image forming operation starts, the photoconductor drum 11 and the transfer drum 21 start rotating in synchronism with each other. At this time, the peripheral velocity V1 of the photoconductor drum 11 is higher than the peripheral velocity V2 of the transfer drum 21. For example, the peripheral velocity V1 of the photoconductor drum 11 is higher than the peripheral velocity V2 of the transfer drum 21 by about 0.5% to 1%.

At this time, both the leading end gripper 23 and the trailing end gripper 27 are open. The leading end gripper 23 rotates together with the transfer drum 21. In contrast, the trailing end gripper 27 does not rotate together with the transfer drum 21, and is at rest at the standby position (the peripheral velocity is zero). To be specific, as illustrated in FIG. 1, the trailing end gripper 27 is disposed so as to face a part of the outer periphery of the transfer drum 21 between the sheet feed position Pa and the transfer region Tr (see FIG. 7A). The sheet smoothing roller 28 is disposed at a position adjacent to the transfer drum 21 (see the position P1 of FIG. 3).

A position of the transfer drum 21 that faces an end of the trailing end gripper 27 that is located at the standby position will be referred to as a position Pc (see FIG. 3). To be specific, the position Pc is a position at which the transfer drum 21 faces one end of the trailing end gripper 27 in the rotation direction (arrow B) of the photoconductor drum 11, the end being nearer to the transfer region Tr. A position of the photoconductor drum 11 at which the photoconductor drum 11 is exposed to light by the exposure device 13 will be referred to as a position Pd (see FIG. 3). The distance from the position Pc to the contact start point Pe through the transfer region Tr along the outer periphery of the transfer drum 21 is smaller than the distance from the position Pd to the contact start point Pe though a side that faces the standby position of the trailing end gripper 27 along the outer periphery of the photoconductor drum 11. The standby position of the trailing end gripper 27 is as close as possible to the contact transfer region Tr so that displacement of an image is suppressed.

After the photosensitive layer 11A of the photoconductor drum 11, which is rotating, has been charged by the charger 12, the exposure device 13 forms an electrostatic latent image of a first color (for example, yellow) in accordance with image information. When the transfer drum 21 starts rotating, the sheet detection sensor 25 measures the phase of the transfer drum 21. The measured phase is sent to the controller 100.

In the rotary developing device 14, a developing unit that contains color toner corresponding to the electrostatic latent image to be formed on the photoconductor drum 11 (for example, the developing unit 14Y for yellow) is rotated and stopped at a position at which the developing unit faces the photoconductor drum 11. The developing unit 14Y, for example, develops the electrostatic latent image on the photoconductor drum 11 and forms a toner image on the photoconductor drum 11. The toner image (here, a yellow toner image) is transported to the transfer region Tr that faces the transfer device 20 as the photoconductor drum 11 rotates.

When the image forming operation starts, the sheet S is supplied. To be specific, the pickup roller 42 picks up the sheet S from the sheet container 41, and the transport roller 44 feeds the sheet S through the separation roller 43 to the feed path 51. The sheet detection sensor 25 detects passing of the leading end of the sheet S in the transport direction, and sends a detection signal to the controller 100. When the controller 100 receives the detection signal, the controller 100 controls transportation of the sheet S on the basis of the detection signal and the phase obtained by the sheet detection sensor 25 so that the sheet S reaches the sheet feed position Pa at the same time as the leading end gripper 23 reaches the sheet feed position Pa. When the sheet S is supplied, the size of the sheet S detected by the sheet-size sensor (not shown) is sent to the controller 100.

Figure 7A:
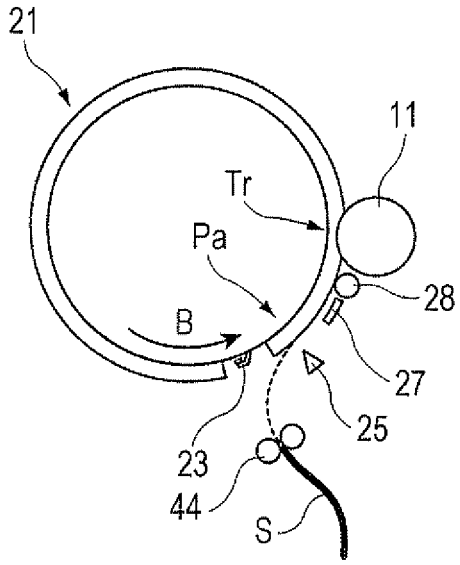
FIGS. 7A to 7D are schematic views illustrating the operation of wrapping a sheet around a transfer drum according to the present exemplary embodiment.
Figure 7B:
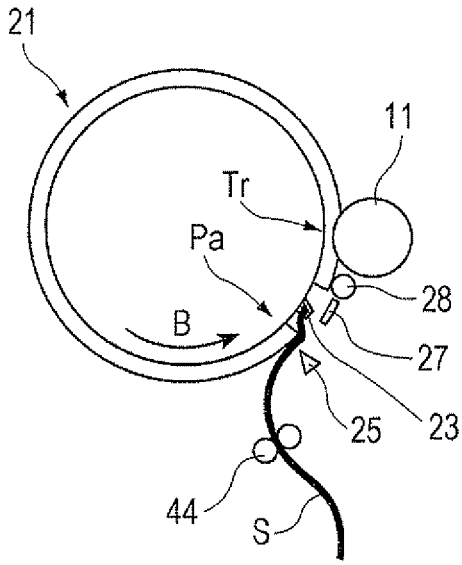

As illustrated in FIG. 7B, when the leading end of the sheet S in the transport direction reaches the sheet feed position Pa, the state of the leading end gripper 23 is changed from the open state to the closed state. As a result, the leading end of the sheet S in the transport direction is gripped by the leading end gripper 23. At this time, the trailing end gripper 27 is at rest at the standby position near the outer periphery of the transfer drum 21. That is, the trailing end gripper 27 is at rest and located at a position that faces a part of the transfer drum 21 between the sheet feed position Pa and the transfer region Tr. The leading end gripper 23, which is gripping the sheet S, passes through a space between the trailing end gripper 27, which is at rest, and the rotation axis of the transfer drum 21 (overtakes the trailing end gripper 27 that is at rest). The transport velocity of the sheet S, which is gripped by the leading end gripper 23, is equal to the peripheral velocity V2 of the transfer drum 21.

The leading end gripper 23, which has passed through the space between the trailing end gripper 27 and the elastic layer 21B (see FIG. 3), passes the transfer region Tr while gripping the sheet S. At this time, the sheet smoothing roller 28 is disposed at the position P1 (see FIG. 3). The sheet smoothing roller 28 presses the sheet S against the elastic layer 21B so that the sheet S is wrapped around the transfer drum 21. When the sheet S has passed the transfer region Tr, a part of the sheet S, which is between the leading end of the sheet S and the transfer region Tr, is lifted from the elastic layer 21B, and the sheet S is warped (see the sheet S in FIG. 7C). This occurs because the sheet S is nipped between the transfer drum 21 and the photoconductor drum 11. That is, as described above, the peripheral velocity V1 of the photoconductor drum 11 is higher than the peripheral velocity V2 of the transfer drum 21, and thereby the transport speed of the sheet S in the transfer region Tr is increased due to the photoconductor drum 11.

Figure 7C:
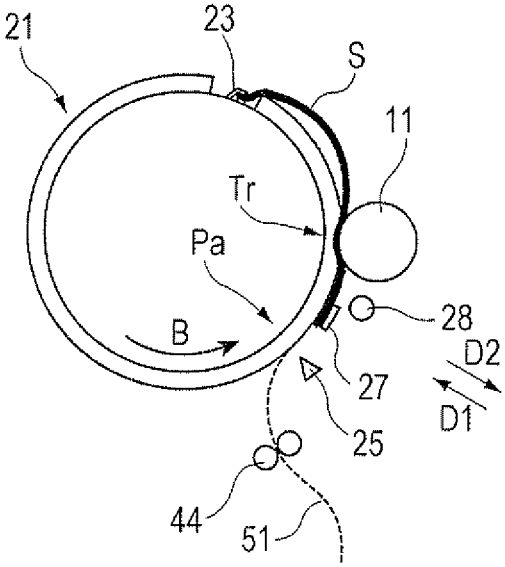

As illustrated in FIG. 7C, the sheet S, which has passed the transfer region Tr while being gripped by the leading end gripper 23, is transported along the rotation path 53 (see FIG. 1) while the sheet S is gripped by the leading end gripper 23 and wrapped around the transfer drum 21. After the exposure device 13 has formed an electrostatic latent image of the first color (for example, yellow) corresponding to image information, the sheet detection sensor 25 detects passing of the trailing end of the sheet S in the transport direction. When the controller 100 receives a signal from the sheet detection sensor 25, the controller 100 issues commands to the trailing end gripper 27 and the sheet smoothing roller 28. When the trailing end gripper 27 receives the command, the state of the trailing end gripper 27 changes from the open state to the closed state (arrow D1). The sheet smoothing roller 28 moves from the position P1 near to the transfer drum 21 to the position P2 away from the transfer drum (arrow D4), and is separated from the sheet S.

Referring to FIGS. 5A to 5C, a movement of the trailing end gripper 27 from the open state (FIG. 5A) to the closed state (FIG. 5B) when the trailing end gripper 27 received a command from the controller 100 will be described in detail. When the command is received, the solenoid (not shown) is driven, and the wedge-shaped lifting members 27*c*, which have been supporting the inner ends of the holding portions 27*b*, are moved in a direction away from the transfer drum 21 (arrow E1 of FIG. 5C). As the wedge-shaped lifting members 27*c* move, the holding portions 27*b*, which are urged by the springs 27*e* and are no longer supported by the wedge-shaped lifting members 27*c*, move toward the inner side of the transfer drum 21. Consequently, the sheet restrictor 27*a*, which is attached to the outer ends of the holding portions 27*b*, approaches the outer peripheral surface of the transfer drum 21 (arrow D1).

When the trailing end gripper 27 is closed, the exposure device 13 has finished forming the electrostatic latent image of the first color (for example, yellow), and the exposure device 13 has not yet started forming an electrostatic latent image of a second color (magenta). That is, while an electrostatic latent image is being formed (during exposure to light), an operation of opening or closing the trailing end gripper 27 is not performed. Therefore, the electrostatic latent image is not blurred due to the movement for opening or closing the trailing end gripper 27. As the velocity of the sheet S is increased when the sheet S passes the transfer region Tr as described above, the relative positions between the sheet S and the transfer drum 21 may be changed on the trailing end side of the sheet S in the transport direction. Therefore, the trailing end gripper 27 holds the sheet S so as to allow a movement of the sheet S in the transport direction.

The trailing end gripper 27, which has been closed, starts rotating in synchronism with the transfer drum 21. To be specific, the trailing end gripper driving motor M2 is driven, and the peripheral velocity of the trailing end gripper 27 becomes the same as the peripheral velocity V2 of the transfer drum 21. The trailing end gripper 27 rotates together with the transfer drum 21 while holding the trailing end of the sheet S in the transport direction, the sheet S being wrapped around the transfer drum 21. In other words, the sheet S rotates together with the transfer drum 21 while the leading end of the sheet S is gripped by the leading end gripper 23 and the trailing end of the sheet S is held by the trailing end gripper 27. When the sheet S passes the transfer region Tr, the leading end gripper 23, which is gripping the sheet S, does not contact the photoconductor drum 11. In contrast, the trailing end gripper 27, which is holding the sheet S, contacts the photoconductor drum 11.

Figure 7D:
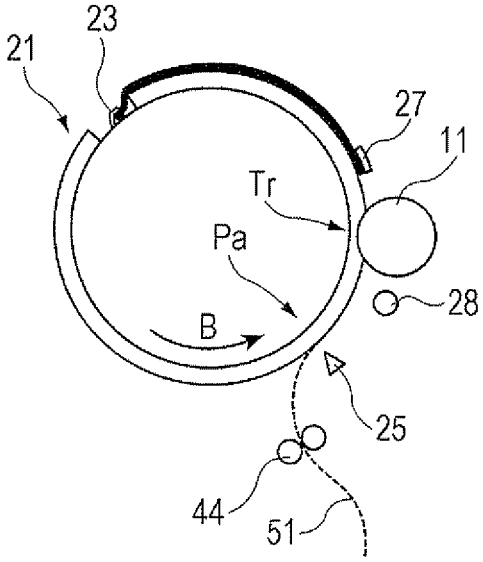

As illustrated in FIG. 7D, the trailing end gripper 27 starts rotating around the rotary shaft 27D (see FIG. 1) in synchronism with the transfer drum 21, and passes the transfer region Tr while holding the sheet S. The first (for example, yellow) toner image formed on the photoconductor drum 11 is transferred to the sheet S on the transfer drum 21 in the transfer region Tr, at which the photoconductor drum 11 and the transfer drum 21 face each other. The cleaner 15 (see FIG. 1) removes toner that is left on the photoconductor drum 11 after the transfer process has been finished.

Figure 8A:
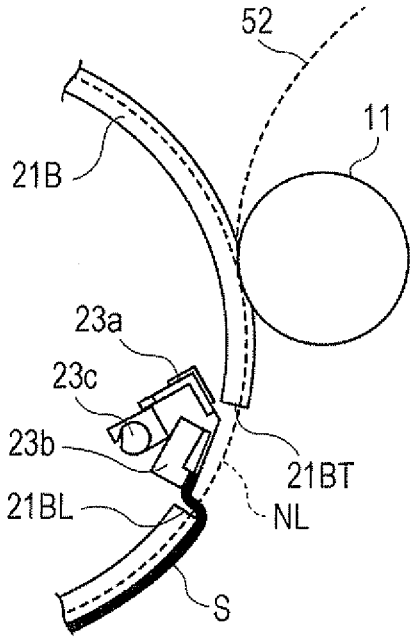
FIGS. 8A to 8D are schematic views illustrating the operation of releasing the sheet, which is wrapped around the transfer drum, from the transfer drum according to the present exemplary.

Forming of an electrostatic latent image, developing, and transfer of the image are repeated for a second color (for example, magenta or cyan) to the last color (for example, black) in the same manner as described above. When forming a toner image of each color, the rotary developing device 14 rotates, and the corresponding one of the developing units 14M and 14C is located at the stop position. Meanwhile, as illustrated in FIGS. 7D and 8A, the sheet S is rotated and transported while being wrapped around the transfer drum 21 by the leading end gripper 23 and the trailing end gripper 27, and toner images of the second to the last colors are successively transferred in an overlapping manner every time the sheet S passes the transfer region Tr. As a result, when forming, for example, a full-color image, toner images of yellow (Y), magenta (M), and cyan (C) (excluding black (K)) are transferred in an overlapping manner on the sheet S on the transfer drum 21. At this time, the sheet smoothing roller 28 is located at the position P2 that is separated from the transfer drum 21 and does not contact the sheet S. Therefore, the sheet smoothing roller 28 does not blur the toner image that is transferred to the sheet S.

Figure 8B:
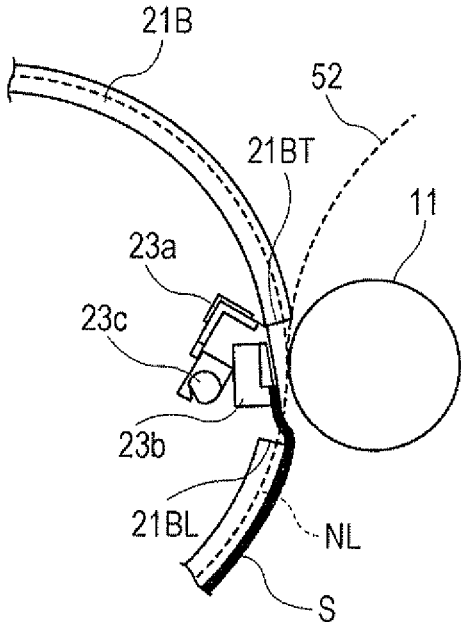
Figure 8C:
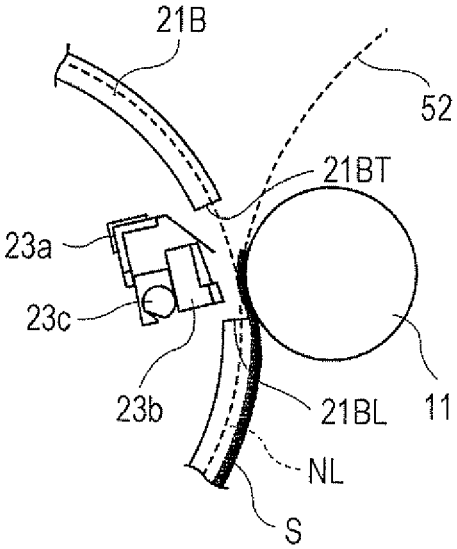
Figure 8D:
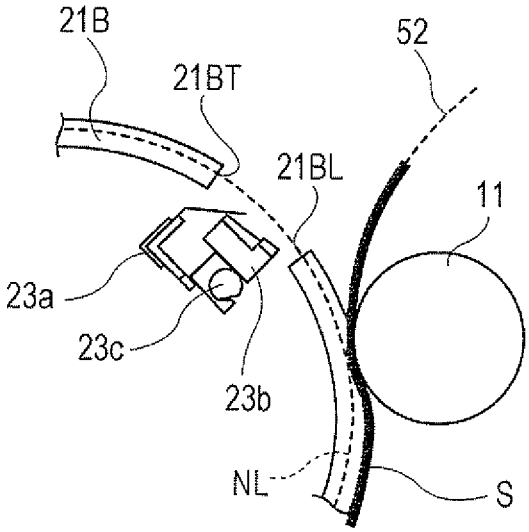

As illustrated in FIG. 8B, when transferring an image of the last color (for example black), in contrast to the previous cases, the leading end gripper 23 releases the sheet S in the transfer region Tr. That is, the state of the leading end gripper 23 changes from the closed state to the open state. In other words, when the exposed portion 21C of the transfer drum 21 passes a region that faces the photoconductor drum 11, the state of the leading end gripper 23 changes from the closed state to the open state. While the state of the leading end gripper 23 is changing from the closed state to the open state, the leading end gripper 23 does not contact the photoconductor drum 11. As illustrated in FIG. 8C, the leading end gripper 23 releases the sheet S, on which a full-color image has been formed, and the leading end of the sheet S in the transport direction is peeled off the transfer drum 21 due to the nip between the elastic layer 21B and the photoconductor drum 11, and the sheet S enters the output path 52 from the sheet output position Pb.

Subsequently, as the sheet S is transported, the trailing end gripper 27, which holds the trailing end of the sheet S in the transport direction, reaches the standby position described above. At the standby position, the state of the trailing end gripper 27 changes from the closed state to the open state (see arrow D2 of FIGS. 5A to 5C). When the state of the trailing end gripper 27 changes from the closed state to the open state, the exposure device 13 has formed an electrostatic latent image of the last color (for example, black) in accordance with the image information. The trailing end gripper 27, which is in the open state, stops at the standby position. That is, the trailing end gripper 27 does not rotate together with the transfer drum 21, and the peripheral velocity of the trailing end gripper 27 becomes zero. The sheet S, which has been released from the trailing end gripper 27, is nipped between the photoconductor drum 11 and the transfer drum 21 in the transfer region Tr. Therefore, the phase of the sheet S is not substantially changed when the trailing end gripper 27 is opened.

The trailing end of the sheet S in the transport direction, which has been released from the trailing end gripper 27, is peeled off the transfer drum 21 and enters the output path 52 from the sheet output position Pb. The sheet S is transported along the output path 52 to the fixing unit 30. The heating roller 31 and the pressing roller 32 of the fixing unit 30 fixes the toner image on the sheet S. After the toner image has been fixed on the sheet S, the sheet S is output to the outside of the image forming apparatus 1 by the transport roller 44 and staked on the sheet stacker 3.

Operation of Holding Sheet S by Trailing End Gripper 27

Next, an operation of holding the sheet S by the trailing end gripper 27 will be described in detail. As described above, the trailing end gripper 27 is closed when the sheet detection sensor 25 detects passing of the trailing end of the sheet S in the transport direction. Therefore, even if the sizes (transport lengths) of the sheets S supplied to the transfer drum 21 for image formation are different from each other, the tailing ends of the sheets S in the transport direction are securely held. If the sheets S having the same size are supplied, the lengths of the sheets S in the transport direction vary in accordance with environmental conditions, such as the humidity and temperature, or a manufacturing error of the sheets S. However, according to the present exemplary embodiment, even if the lengths of the sheets S in the transport direction vary, the trailing ends of the sheet S in the transport direction are securely held. Deviation in the position of the image formed on the sheet S is suppressed, because the trailing end of the sheet S in the transport direction is securely held. Moreover, a margin of the sheet S may be reduced.

Operation of Gripping Sheet S by Leading End Gripper 23

Next, referring to FIGS. 4A, 4B, and 7A to 7D, an operation of gripping the leading end of the sheet S in the transport direction by the leading end gripper 23 will be described in detail. As illustrated in FIG. 7B, when the leading end of the sheet S in the transport direction reaches the sheet feed position Pa, the state of the leading end gripper 23 changes from the open state (FIG. 4A) to the closed state (FIG. 4B).

To be specific, the leading end gripper 23 performs the following operation. First, as illustrated in FIGS. 4A and 7A, when the leading end gripper 23 is in the open state, the outer member 23*a* of the leading end gripper 23 is disposed at an upstream position with respect to the transport direction of the sheet S (on the left side of FIG. 4A), and the inner member 23*b* of the leading end gripper 23 is disposed on an inner side of the transfer drum 21 (on the lower side of FIG. 4A). When the leading end of the sheet S in the transport direction reaches the sheet feed position Pa, the outer member 23*a* rotates around the rotary shaft 23*c* toward the trailing end of the sheet S in the transport direction (arrow F2 of FIG. 4A). As the outer member 23*a* rotates, the edge portion 23*a*3 of the outer member 23*a* moves toward the outer side of the transfer drum 21. Due to the movement of the edge portion 23*a*3, the inner member 23*b*, which has been in contact with the edge portion 23*a*3, is pushed toward the outer side of the transfer drum 21 along a guide member (not shown). As a result, the inner member 23*b* moves toward the outer side of the transfer drum 21 (arrow D6 of FIG. 4A). Thus, as illustrated in FIGS. 4B and 7B, the gap between the outer pressing portion 23*a*1 and the inner pressing portion 23*b*1 decreases, and the sheet S is gripped between the outer pressing portion 23*a*1 and the inner pressing portion 23*b*1.

At this time, because the transport velocity of the sheet S in the transfer region Tr increases, the sheet S may be warped (see the sheet S in FIG. 7C). However, even when the sheet S is warped, the leading end of the sheet S in the transport direction, which is gripped by the leading end gripper 23, is not moved relative to the transfer drum 21. Therefore, the phase of the sheet S in the transport direction is changed, whereby displacement of an image formed on the sheet S is suppressed.

Operation of Releasing Sheet S by Leading End Gripper 23

Referring to FIGS. 1, 3, 4A, 4B, and 8A to 8D, an operation of releasing the leading end of the sheet S in the transport direction by the leading end gripper 23 will be described in detail. As illustrated in FIG. 8B, when the leading end gripper 23 reaches the transfer region Tr (see FIG. 3), the state of the leading end gripper 23 (see FIG. 1) changes from the closed state (see FIG. 4B) to the open state (see FIG. 4A). The operation of releasing the sheet S by the leading end gripper 23 is an operation opposite to the operation of gripping the sheet S by the leading end gripper 23. Therefore, detailed description will be omitted, and only the difference from the operation of gripping the sheet S will be described here.

First, the position at which the leading end gripper 23 starts releasing the sheet S will be described. The leading end gripper 23 starts releasing the sheet S after the leading end of the sheet S in the transport direction has entered the transfer region Tr. That is, after the leading end of the sheet S in the transport direction has passed the contact start point Pe (see FIG. 3), the leading end gripper 23 opens and starts releasing the sheet S.

Next, a movement of the leading end of the sheet S in the transport direction after the leading end has been released will be described. After the leading end of the sheet S in the transport direction has passed the contact start point Pe, the leading end 21BL of the elastic layer (see FIG. 3) enters the transfer region Tr (see FIG. 8C). That is, the leading end 21BL of the elastic layer passes the contact start point Pe (see FIG. 3). At this time, the elastic layer 21B and the photoconductor drum 11 form a nip therebetween, whereby the leading end of the sheet S in the transport direction is peeled off the transfer drum 21. To be specific, the leading end of the sheet S in the transport direction is peeled off the transfer drum 21 due to the rigidity of the sheet S. Then, the leading end of the sheet S in the transport direction is output to the output path 52 (see FIG. 8D).

Irrespective of whether the leading end gripper 23 is in the closed state, in a state of being opened, or in the open state, the leading end gripper 23 does not contact the photoconductor drum 11. This is because of the following mechanism. The elastic layer 21B of the transfer drum 21 is pressed by the photoconductor drum 11 when the transfer drum 21 and the photoconductor drum 11 form a nip therebetween in the transfer region Tr. In FIGS. 4A, 4B, and 8A to 8D, the outer periphery of the transfer drum 21 that is pressed and compressed is illustrated as a compressed peripheral line NL. In these figures, the compressed peripheral line NL is drawn over the entire periphery of the transfer drum 21 for clarity. If the leading end gripper 23 does not cross over the compressed peripheral line NL toward the outer side of the transfer drum 21, the leading end gripper 23 does not contact the photoconductor drum 11. In the present exemplary embodiment, as illustrated in FIGS. 4A, 4B, and 8A to 8D, the members of the leading end gripper 23 (such as the outer member 23*a* and the inner member 23*b*) are disposed on the inner side of the compressed peripheral line NL irrespective of whether the leading end gripper 23 is in the open closed, in a state of being opened, or in the closed state. Therefore, the leading end gripper 23 does not contact the photoconductor drum 11.

Heretofore, the operations of opening and closing the leading end gripper 23 have been described. The time during which the state of the leading end gripper 23 is changed from the closed state to the open state is shorter than the time during which the state of the leading end gripper 23 is changed from the open state to the closed state. To be specific, the time during which the outer member 23*a* rotates in the direction of arrow F1 around the rotary shaft 23*c* is shorter than the time during which the outer member 23*a* rotates in the direction of arrow F2. Thus, when the leading end gripper 23 grips the sheet S, the sheet S is securely gripped, and when the leading end gripper 23 releases the sheet S, the sheet S is rapidly released.

According to the present exemplary embodiment, the outer member 23*a* of the leading end gripper 23 performs a rotational movement (arrow F1 and F2), and the inner member 23*b* performs a linear movement (arrow D5 and D6). Due to this combination of movements, the leading end gripper 23 does not contact the photoconductor drum 11 and securely grips the sheet S.

The leading end gripper 23 may release the sheet S at the following time. That is, the leading end gripper 23 may release the sheet S after the leading end 21BL of the elastic layer had entered (see FIG. 8C) the transfer region Tr (see FIG. 3), i.e., after the leading end 21BL of the elastic layer has passed the contact start point Pe (see FIG. 3). If the leading end gripper 23 releases the sheet S at this time, the phase shift of the sheet S is reduced. This is because, after the sheet S has been gripped by the leading end gripper 23, the sheet S is either gripped by the leading end gripper 23 or nipped between the elastic layer 21B and the photoconductor drum 11. That is, the sheet S is not completely free during any time without having the leading end of the sheet S in the transport direction being gripped by the leading end gripper 23. Because the phase shift of the sheet S is reduced, displacement of an image formed on the sheet S is further reduced.

Difference Between Peripheral Velocities of Photoconductor Drum 11 and Transfer Drum 21

As described above, the peripheral velocity V1 of the photoconductor drum 11 is higher than the peripheral velocity V2 of the transfer drum 21. This is because the displacement of an image is reduced as described below. First, the distance between the rotation axes of the photoconductor drum 11 and the transfer drum 21 is constant. Because the distance between the rotation axes of the photoconductor drum 11 and the transfer drum 21 is constant, the nip pressure at the transfer region Tr varies as the transfer drum 21 and the photoconductor drum 11 rotate. For example, the transfer drum 21, which includes the leading end gripper 23 and other components, performs eccentric rotation and wobbles, so that the nip pressure in the transfer region Tr varies. Moreover, the nip pressure may vary due to the imprecision of the outer diameter of the transfer drum 21. This occurs because the outer peripheral surface of the transfer drum 21 is covered with the elastic layer 21B made of a polyurethane resin or the like. It is difficult to precisely form the elastic layer 21B from a polyurethane resin or the like. As a result, the outer diameter of the transfer drum 21 has a deviation.

The transfer drum 21, around which the sheet S is wrapped and held, has a larger diameter than the photoconductor drum 11. Therefore, the variation in the driving load of the transfer drum 21, which may be generated due to the variation in the nip pressure in the transfer region Tr, is larger than the variation in the driving load of the photoconductor drum 11. The variation in the driving load deflects the driving system of the transfer drum 21 and displaces the rotation position of the transfer drum 21. The displacement of the rotation position displaces the position of the image formed on the sheet S. In contrast, the photoconductor drum 11 has a small diameter than the transfer drum 21, and the variation in the driving load is smaller. Therefore, the deflection of the driving system of the photoconductor drum 11 is smaller than the deflection of the driving system of the transfer drum 21, and the displacement of the rotation position of the photoconductor drum 11 is smaller than the displacement of the rotation position of the transfer drum 21. Therefore, by rotating the sheet S together with the photoconductor drum 11 instead of the transfer drum 21, the displacement of an image formed on the sheet S is reduced.

In order to make the sheet S to be controlled by the photoconductor drum 11, according to the present exemplary embodiment, the peripheral velocity V1 of the photoconductor drum 11 is set to be higher than the peripheral velocity V2 of the transfer drum 21. Thus, the sheet S follows the photoconductor drum 11, which has a smaller variation in the driving load, instead of the transfer drum 21, which has a larger variation in the driving load. Therefore, the displacement in the position of the image is reduced. Moreover, print density is made more uniform and color misregistration is reduced when forming a multicolor image. The sheet S follows the photoconductor drum 11 in the sense that the transport velocity of the sheet S is higher than the peripheral velocity V2 of the transfer drum 21 and is close to the peripheral velocity V1 of the photoconductor drum 11. When the transport velocity of the sheet S is higher than the peripheral velocity V2 of the transfer drum 21, presumably, the sheet S slips over the outer peripheral surface of the transfer drum 21 in the transfer region Tr.

If the friction between the sheet S and the photoconductor drum 11 is higher than the friction between the sheet S and the elastic layer 21B, the sheet S easily follows the photoconductor drum 11. If the sheet S is electrostatically attracted to the photoconductor drum 11 in the transfer region Tr, the sheet S easily follows the photoconductor drum 11.

Other Exemplary Embodiments

Figure 9A:
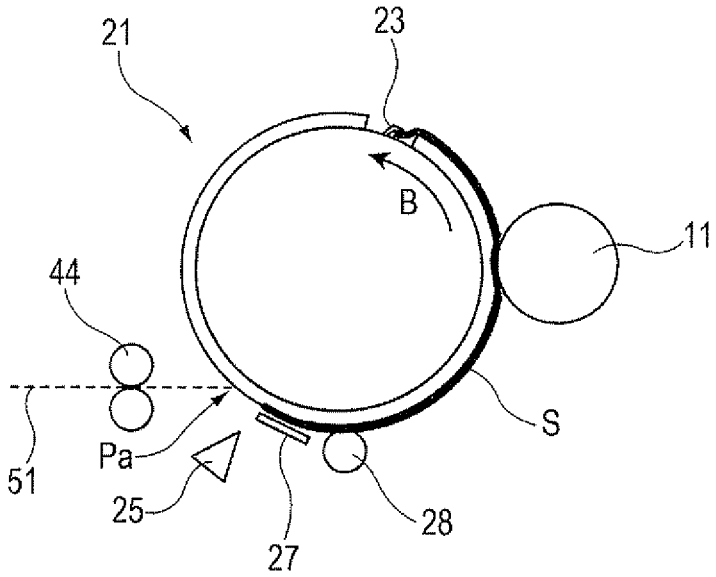
FIGS. 9A to 9C are schematic views illustrating other exemplary embodiments.
Figure 9B:
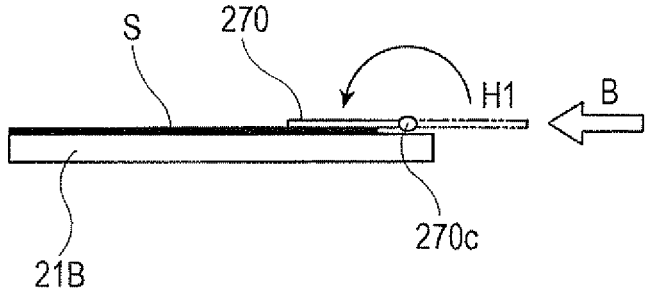
Figure 9C:
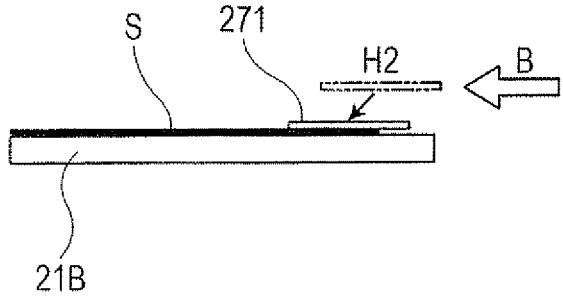

Referring to FIGS. 9A to 9C, exemplary embodiments other than the present exemplary embodiment will be described. FIGS. 9A to 9C are schematic views illustrating the other embodiments. In the exemplary embodiment described above, the sheet feed position Pa at which the sheet S is supplied to the transfer drum 21 is disposed near to the transfer region Tr. However, the sheet feed position is not limited thereto. For example, as illustrated in FIG. 9A, the sheet feed position Pa may be located at a position opposite to the transfer region Tr (see FIG. 3) of the transfer drum 21. In this case, the sheet detection sensor 25, the standby position of the trailing end gripper 27, and the sheet smoothing roller 28 are disposed close to the sheet feed position Pa, which is located opposite to the transfer region Tr of the transfer drum 21.

In the exemplary embodiment described above, the trailing end gripper 27 is at rest at the standby position, and when the trailing end of the sheet S in the transport direction passes, the distance between the trailing end gripper 27 and the outer surface of the transfer drum 21 is changed (arrow D5 in FIGS. 4A and 4B), and then the trailing end gripper 27 is rotated together with the transfer drum 21 and holds the trailing end of the sheet S. However, the movement of the trailing end gripper 27 is not limited thereto. For example, even when the trailing end gripper 27 is not holding the sheet S, the trailing end gripper 27 may rotate together with the transfer drum 21 instead of staying at rest at the standby position, and may hold the trailing end of the sheet S in the transport direction after the trailing end gripper 27 has overtaken the trailing end of the sheet S. As a specific example, a trailing end gripper 270 illustrated in FIG. 9B includes a rotary shaft 270*c* that is disposed on the leading end side in the movement direction (arrow B) of the trailing end gripper 27, and the rotary shaft 270*c* extends in a direction parallel to the rotary shaft 21D of the transfer drum 21 (see FIG. 1). The trailing end gripper 270 rotates together with the transfer drum 21 even when the trailing end gripper 270 is not holding the sheet S. When the trailing end gripper 270 holds the trailing end of the sheet S in the transport direction, the trailing end gripper 270 moves at a velocity higher than the transport velocity of the sheet S and overtakes trailing end of the sheet S in the transport direction (arrow B). Subsequently, the trailing end gripper 270 rotates around the rotary shaft 270*c* in a direction in which the trailing end gripper 270 moves away from the elastic layer 21B (arrow H1), and holds the trailing end of the sheet S in the transport direction. As another example, a trailing end gripper 271 illustrated in FIG. 9C is configured to be movable (arrow H2) toward the leading end of the sheet S in the transport direction while changing the distance between the trailing end gripper 271 and the outer peripheral surface of the transfer drum 21. The trailing end gripper 271 rotates together with the transfer drum 21 even when the trailing end gripper 271 is not holding the sheet S. When the trailing end gripper 271 holds the trailing end of the sheet S in the transport direction, the trailing end gripper 271 moves at a velocity higher than that of the transport velocity of the sheet S, and overtakes the trailing end of the sheet S in the transport direction (arrow B1). Subsequently, the distance between the trailing end gripper 271 and the outer peripheral surface of the transfer drum 21 is reduced, and the trailing end gripper 271 moves toward the leading end of the sheet S in the transport direction (arrow H2), and holds the trailing end of the sheet S in the transport direction.

Elastic follower members, which are not disposed in the exemplary embodiment described above, may be disposed on the base portion 21A of the transfer drum 21. The elastic follower members contact the sheet restrictor 27*a* of the trailing end gripper 27 in the closed state. By disposing the elastic follower members, the friction between the transfer drum 21 and the trailing end gripper 27 is increased. Thus, the trailing end gripper 27 more reliably follows the transfer drum 21. That is, a deviation of the rotation of the trailing end gripper 27 from the rotation of the transfer drum 21 is reduced. The elastic follower members are disposed on the outer peripheral surface of the base portion 21A (see FIGS. 5A to 5C) of the transfer drum 21. To be specific, the elastic follower members are disposed at positions near to the ends of the rotary shaft 21D of the transfer drum 21 (left and right ends in FIGS. 5A to 5C) and in regions in which the elastic layer 21B is not disposed.

In the exemplary embodiment described above, as illustrated in FIGS. 5A to 5C, the driving source of the trailing end gripper 27 is the trailing end gripper driving motor M2. The trailing end gripper driving motor M2 drives one end of the rotary shaft 27D of the trailing end gripper 27. However, the driving source is not limited thereto. As illustrated in FIGS. 5A to 5C, because the length of the trailing end gripper 27 extends parallel to the rotary shaft 27D of the trailing end gripper 27, the phases of the ends of the trailing end gripper 27 in the direction parallel to the rotary shaft 27D (hereinafter simply referred to as both ends of the trailing end gripper 27) may be aligned. First, for example, two trailing end gripper driving motors M2 may be used so as to drive both ends of the trailing end gripper 27. Thus, the phases of both ends of the trailing end gripper 27 are more reliably aligned. Second, a trailing end gripper synchronization member, which is independent of the rotary shaft 27D of the trailing end gripper 27, may be disposed along the rotary shaft 27D. The trailing end gripper synchronization member is rigid, and the ends thereof in a direction parallel to the rotary shaft 27D are respectively connected to the ends of the trailing end gripper 27. The trailing end gripper synchronization member rotates together with the trailing end gripper 27, whereby the phases at both ends of the trailing end gripper 27 are aligned without increasing the number of driving members. Third, in addition to the trailing end gripper synchronization member, a synchronization member driving unit that drives the trailing end gripper synchronization member may be provided. Thus, as compared with the case where the synchronization member driving unit is not provided, the phases at both ends of the trailing end gripper 27 are more precisely aligned. Fourth, in addition to the trailing end gripper synchronization member, a clutch, which is configured to stop the trailing end gripper synchronization member at certain positions, may be provided. Thus, as compared with the case where the clutch is not provided, the trailing end gripper 27 is operated more flexibly.

In the exemplary embodiment described above, in accordance with the length of the sheet S in the transport direction, the timings at which the trailing end gripper 27 holds the sheet S is changed, i.e., the position of the trailing end gripper 27 relative to the leading end gripper 23 is changed. However, this is not limited thereto. For example, the position of the leading end gripper 23 on the transfer drum 21 relative to the trailing end gripper 27 may be changed. Alternatively, the positions of the leading end gripper 23 and the trailing end gripper 27 may be changed.

In the exemplary embodiment described above, when transferring the last color (for example, black), the leading end gripper 23 releases the sheet S in the transfer region Tr, and the trailing end gripper 27 releases the sheet S before entering the transfer region Tr. However, this is not limited thereto. For example, when transferring the last color, the leading end gripper 23 and the trailing end gripper 27 may hold the sheet S as in the cases of other colors. After the last color has been transferred, the transfer drum 21 may rotates one more time, and then the leading end gripper 23 and the trailing end gripper 27 may release the sheet S so that the sheet S is peeled of the transfer drum 21. When the sheet S passes the transfer region Tr after the transfer drum 21 has rotated one more time, transfer is not performed in the transfer region Tr. By making the leading end gripper 23 and the trailing end gripper 27 hold the sheet S when transferring the last color, the quality of an image formed on the sheet S is improved.

In the exemplary embodiment described above, a full-color image is formed. However, this is not limited thereto. A monochrome image may be formed. A monochrome image may be formed by using the following mechanism. That is, only the leading end gripper 23 holds the sheet S, and the trailing end gripper 27 does not hold the sheet S. To be specific, after the leading end gripper 23 grips the sheet S at the sheet feed position Pa, the leading end gripper 23 releases the sheet S in the transfer region Tr when the leading end gripper 23 first passes the transfer region Tr. In this case, the sheet S does not rotate on the outer periphery of the transfer drum 21.

Alternatively, in order to form a monochrome image with a higher quality, the following mechanism may be used. That is, the leading end gripper 23 and the trailing end gripper 27 may hold the sheet S. To be specific, while the leading end gripper 23 and the trailing end gripper 27 hold the sheet S, after a monochrome toner image has been transferred and the transfer drum 21 rotates once, the leading end gripper 23 and the trailing end gripper 27 may release the sheet S so that the sheet S is peeled off the transfer drum 21. When the sheet S passes the transfer region Tr after rotating one more time, transfer is not performed in the transfer region Tr. By making the leading end gripper 23 and the trailing end gripper 27 hold the sheet S, the quality of an image formed on the sheet S is improved.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that is rotatably disposed, the image carrier carrying an image on an outer peripheral surface thereof;

a transfer member that is rotatably disposed so as to face the image carrier, the transfer member transferring the image carried by the image carrier to a sheet that is nipped between the transfer member and the image carrier;

a leading end gripping member that is attached to the transfer member, the leading end gripping member gripping a leading end of the sheet in a transport direction on an outer peripheral surface of the transfer member, the sheet being supplied to the transfer member;

a trailing end holding member that holds a trailing end of the sheet in the transport direction between the trailing end holding member and the outer peripheral surface of the transfer member, the sheet being supplied to the transfer member; and a controller that changes a distance between the leading end gripping member and the trailing end holding member when holding the sheet on the basis of a length of the sheet in the transport direction, the sheet being supplied to the transfer member, wherein the trailing end holding member does not rotate together with the transfer member when the trailing end holding member is not holding the sheet.

2. The image forming apparatus according to claim 1, wherein the trailing end holding member is rotatable coaxially with the transfer member, the trailing end holding member is disposed in a predetermined position when the trailing end holding member is not holding the sheet, and the trailing end holding member rotates together with the transfer member when the trailing end holding member is holding the sheet.

3. The image forming apparatus according to claim 2, wherein, when the trailing end holding member is not holding the sheet, the trailing end holding member stands by at a position on the outer peripheral surface of the transfer member, the position being located between a sheet feeding position to which the sheet is supplied and a transfer region in which the image carrier faces the transfer member.

4. The image forming apparatus according to claim 3, wherein the controller includes a sheet detector that detects passing of the trailing end of the sheet in the transport direction, and on the basis of detection of the passing of the trailing end of the sheet in the transport direction by the sheet detector, the controller changes the distance between the leading end gripping member and the trailing end holding member when holding the sheet.

5. The image forming apparatus according to claim 4, wherein the sheet detector is disposed upstream of the predetermined position with respect to the transport direction of the sheet.

6. The image forming apparatus according to claim 2, wherein, when the sheet is supplied to the transfer member, the leading end gripping member passes the trailing end holding member while gripping the sheet that is supplied.

7. The image forming apparatus according to claim 6, wherein the controller includes a sheet detector that detects passing of the trailing end of the sheet in the transport direction, and on the basis of detection of the passing of the trailing end of the sheet in the transport direction by the sheet detector, the controller changes the distance between the leading end gripping member and the trailing end holding member when holding the sheet.

8. The image forming apparatus according to claim 7, wherein the sheet detector is disposed upstream of the predetermined position with respect to the transport direction of the sheet.

9. The image forming apparatus according to claim 2, wherein the controller includes a sheet detector that detects passing of the trailing end of the sheet in the transport direction, and on the basis of detection of the passing of the trailing end of the sheet in the transport direction by the sheet detector, the controller changes the distance between the leading end gripping member and the trailing end holding member when holding the sheet.

10. The image forming apparatus according to claim 9, wherein the sheet detector is disposed upstream of the predetermined position with respect to the transport direction of the sheet.

11. The image forming apparatus according to claim 1, wherein the controller includes a sheet detector that detects passing of the trailing end of the sheet in the transport direction, and on the basis of detection of the passing of the trailing end of the sheet in the transport direction by the sheet detector, the controller changes the distance between the leading end gripping member and the trailing end holding member when holding the sheet.

12. The image forming apparatus according to claim 11, wherein the sheet detector is disposed upstream of a predetermined position with respect to the transport direction of the sheet.

13. A method of image forming comprising:

carrying an image on an outer peripheral surface of an image carrier;

transferring the image carried by the image carrier to a sheet that is nipped between a transfer member and the image carrier;

gripping a leading end of the sheet with a leading end gripping member in a transport direction on an outer peripheral surface of the transfer member, the leading end gripping member being attached to the transfer member;

holding a trailing end of the sheet with a trailing end holding member in the transport direction between the trailing end holding member and the outer peripheral surface of the transfer member; and changing a distance between the leading end gripping member and the trailing end holding member when holding the sheet on the basis of a length of the sheet in the transport direction, wherein the trailing end holding member does not rotate together with the transfer member when the trailing end holding member is not holding the sheet.

14. The method according to claim 13, wherein the trailing end holding member is rotatable coaxially with the transfer member, the trailing end holding member is disposed in a predetermined position when the trailing end holding member is not holding the sheet, and the trailing end holding member rotates together with the transfer member when the trailing end holding member is holding the sheet.

15. The method according to claim 14, wherein, when the trailing end holding member is not holding the sheet, the trailing end holding member stands by at a position on the outer peripheral surface of the transfer member, the position being located between a sheet feeding position to which the sheet is supplied and a transfer region in which the image carrier faces the transfer member.

* * * * *